United States Patent [19]

Gratzfeld

[11] 4,411,554

[45] Oct. 25, 1983

[54] MATERIAL SPREADER AND BRIDGE

[76] Inventor: Edward P. Gratzfeld, Rte. 1, Box 259, Yankton, S. Dak. 57078

[21] Appl. No.: 313,455

[22] Filed: Oct. 21, 1981

[51] Int. Cl.[3] ..... E01C 19/18

[52] U.S. Cl. ..... 404/110; 404/101; 404/96

[58] Field of Search ..... 404/110, 118, 108, 102, 404/104, 101, 106, 96; 425/219, 218

[56] References Cited

U.S. PATENT DOCUMENTS

| | | | |
|---|---|---|---|
| 1,724,043 | 8/1929 | Robb | 404/106 |
| 1,743,114 | 1/1930 | Carr | 404/106 |
| 2,789,485 | 4/1957 | Lindgren | 404/106 |
| 2,969,720 | 1/1961 | Burnham | 404/106 |
| 3,043,201 | 7/1962 | Maxon | 404/106 |
| 3,139,202 | 6/1964 | Kammerlin | 404/106 X |
| 3,188,928 | 6/1965 | Guntert | 404/108 |
| 3,294,001 | 12/1966 | Thomson | 404/120 X |
| 3,392,641 | 7/1968 | Kessel | 404/102 |
| 3,870,427 | 3/1975 | Allen | 404/103 |
| 3,969,056 | 7/1976 | Larsen | 425/218 |
| 4,349,294 | 9/1982 | Allen | 404/110 |

*Primary Examiner*—Nile C. Byers, Jr.
*Attorney, Agent, or Firm*—Zarley, McKee, Thomte, Voorhees & Sease

[57] ABSTRACT

A material spreader and bridge is described including a pair of spaced-apart wheeled frames having an elongated horizontally disposed bridge secured to and extending therebetween. A hopper assembly is movably mounted on the bridge and includes an apparatus for moving the hopper assembly between the ends of the bridge. The hopper assembly comprises a pair of hoppers which are positioned on opposite sides of the bridge and which are designed to spread material on a surface therebelow as the hopper assembly is moved between the ends of the bridge.

8 Claims, 13 Drawing Figures

MATERIAL SPREADER AND BRIDGE

BACKGROUND OF THE INVENTION

This invention relates to a material spreader and more particularly to a material spreader and bridge for spreading hardening material on a concrete surface or the like.

In industrial environments, it is ordinarily desirable to spread hardening materials over newly poured concrete floors to increase the life of the floor. The hardening materials may comprise quartz, mineral, metallic, etc. Originally, the hardening materials were hand cast over the concrete surface but such hand casting resulted in an uneven distribution of the hardening materials.

Attempts have been made to provide mechanical devices for spreading the hardening materials on a concrete floor but the prior art devices are generally cumbersome, expensive and difficult to maneuver. One type of prior art material spreader is manufactured by Allen Engineering Corporation, Paragoul, Ark. and generally comprises a pair of spaced-apart tracks having wheels on opposite ends thereof which are positioned on opposite sides of the concrete floor with the tracks extending over the floor. A spreader assembly is movably mounted on the tracks and is movable from one end of the tracks to the other to spread material on a concrete floor. A problem associated with devices of this type is that workmen have difficulty moving from one end of the tracks to the other when the spreader assembly is mounted on the tracks.

Therefore, it is a principal object of the invention to provide a material spreader and bridge which is lightweight, portable and versatile.

A further object of the invention is to provide a material spreader and bridge which includes a substantially unobstructed bridge to permit workmen to position themselves thereon to perform finishing operations on the concrete floor.

A still further object of the invention is to provide a material spreader and bridge which is comprised of a plurality of boom sections mounted together in an end-to-end relationship.

A further object of the invention is to provide a material spreader and bridge including a bridge which is selectively vertically movably mounted on a pair of wheeled frames.

A still further object of the invention is to provide a material spreader and bridge including a hopper assembly movably mounted on a bridge wherein the hopper assembly is easily removed from the bridge.

A still further object of the invention is to provide a material spreader and bridge including wheeled end frames having a brake means mounted thereon.

A still further object of the invention is to provide a material spreader and bridge including a bridge extending between a pair of wheeled frames wherein at least one of the wheeled frames has an alternate pair of wheels mounted thereon.

A still further object of the invention is to provide a material spreader and bridge including means for preventing the bridging or clogging of the hardening materials within the hopper assembly.

A still further object of the invention is to provide a material spreader and bridge including means for insuring that the hardening material will be properly distributed on the concrete floor.

A still further object of the invention is to provide a portable material spreader and bridge including a hopper assembly mounted on a bridge which is moved from one end of the bridge to the other by an electric motor.

These and other objects will be apparent to those skilled in the art.

DESCRIPTION OF THE PREFERRED EMBODIMENT

Figures 1, 2, 3, 4, 5, 6:
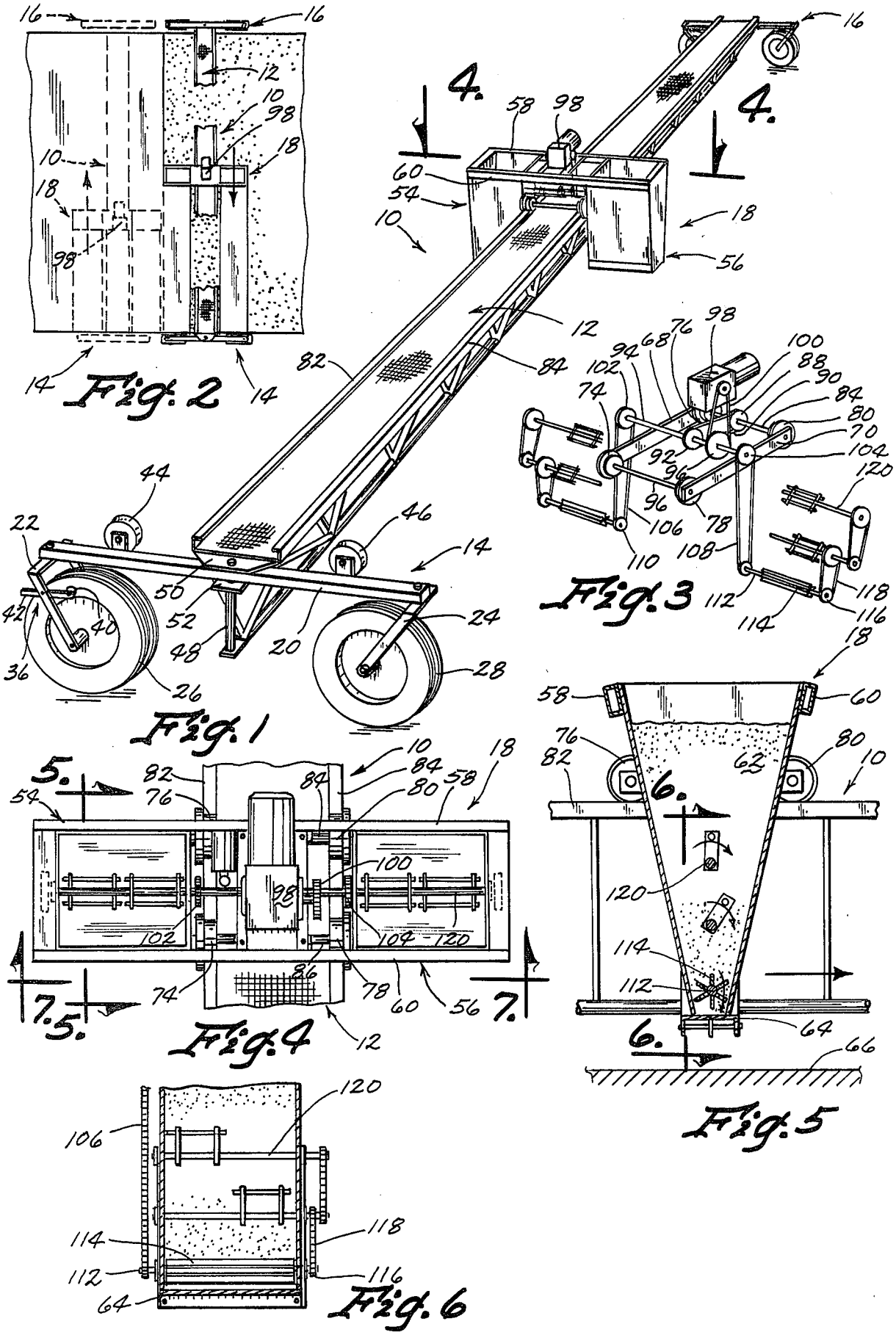
FIG. 1 is a perspective view of the material spreader and bridge of this invention.
FIG. 2 is a plane view illustrating the material spreader and bridge being used to spread material on a concrete slab.
FIG. 3 is a perspective schematic view of the power train of the invention.
FIG. 4 is an enlarged view as seen on lines 4—4 of FIG. 1.
FIG. 5 is a sectional view seen on lines 5—5 of FIG. 4.
FIG. 6 is a sectional view seen on lines 6—6 of FIG. 5.
Figure 7:
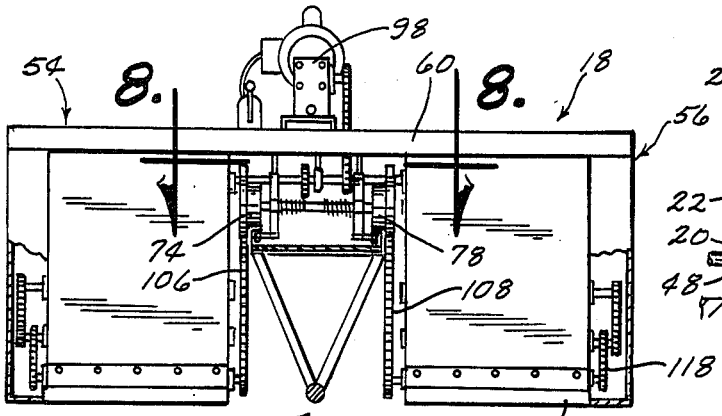
FIG. 7 is a sectional view seen on lines 7—7 of FIG. 4.

The material spreader of this invention is referred to generally by the reference numeral 10 and generally includes a bridge 12 extending between a pair of wheeled frames 14 and 16 and having a hopper assembly 18 movably mounted on the bridge 12 as will be described in more detail hereinafter.

Figure 11:
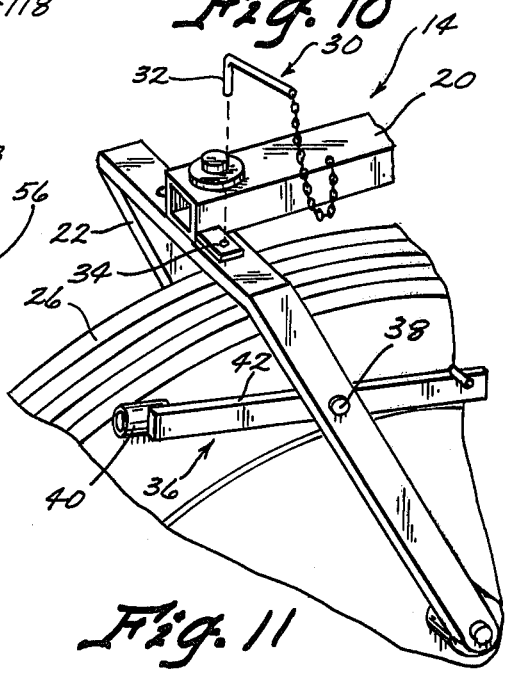
FIG. 11 is a partial perspective view illustrating the brake means and the means for locking the caster wheel in position.

Frame 14 includes horizontally disposed frame member 20 having a pair of wheel forks 22 and 24 pivotally mounted at the opposite ends thereof. Wheels 26 and 28 are rotatably mounted on the forks 22 and 24 respectively. As best seen in FIG. 11, the frame 14 is provided with a locking assembly referred to generally by the reference numeral 30 which is designed to lock the fork 22 in its working position by means of the pin 32 extending through bracket 34 and into the upper portion of the fork 22. FIG. 11 also illustrates a brake means 36 which is pivotally secured to the fork 22 and 38. When the brake means 36 is in the position of FIG. 11, the collar 40, which is welded to the arm 42, frictionally engages the side of the wheel 26 to prevent rotational movement thereof.

Figure 10:
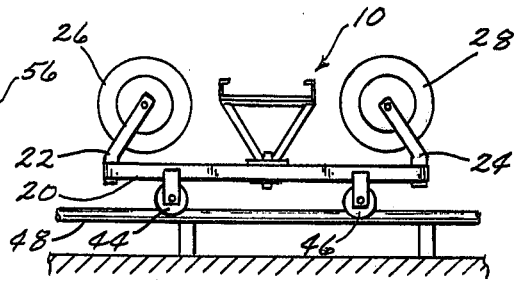
FIG. 10 is an end view of the invention illustrating the alternate position of the wheeled frame.

Frame 14 also includes a pair of alternate concave wheels 44 and 46 which are mounted on the frame member 20 as best seen in FIG. 1. The wheels 44 and 46 are designed to roll upon an elongated pipe member 48 (FIG. 10) when the frame 14 is in its alternate position as will also be described in more detail hereinafter.

Frame 16 is identical to frame 14 and may or may not have the alternate wheels mounted thereon as desired.

Bridge 12 is comprised of a plurality of bridge sections which are bolted together to achieve the desired length. Although the details of the bridge sections have not been illustrated, it should be understood that the bridge 12 may be comprised of as many sections as necessary. The opposite ends of the bridge 12 include a vertically disposed rod or pipe 48 having a plurality of vertically spaced openings formed therein. The pipe 48 is removably mounted on each end of the bridge 12 to permit the bridge 12 to be vertically adjustably positioned on the frames 14 and 16. FIG. 1 illustrates bridge 12 in its uppermost position with respect to the frames with the frame member 20 being received between the plates or brackets 50 and 52 which extend outwardly from bridge 12 through which the pipe 48 extends. If it is desired to lower the bridge 12 with respect to the frames 14 and 16, the pipe 48 is removed and the brackets 50 and 52 would be positioned below frame member 20 and held in various vertical positions with respect to the pipe 48 by a pin or the like extending through the pipe 48.

Hopper assembly 18 generally comprises a pair of spaced-apart hoppers 54 and 56 which are positioned on opposite sides of the bridge 12 as illustrated in the drawings. Inasmuch as the hoppers 54 and 56 are identical, only hopper 54 will be described in detail. Hopper assembly 18 includes a pair of transversely extending frames 58 and 60 which support the hoppers as seen in the drawings. Each of the hoppers 54 and 56 have an open upper end adapted to receive the hardening material or the material to be spread therein which is referred to generally by the reference numeral 62. Each of the hoppers taper downwardly from its upper end to the discharge end or lower end which is selectively closed by a gate assembly referred to generally by the reference numeral 64. The gate assembly 64 may be selectively adjusted to vary the rate of flow of the material 62 to the surface of the concrete slab 66.

Figure 8:
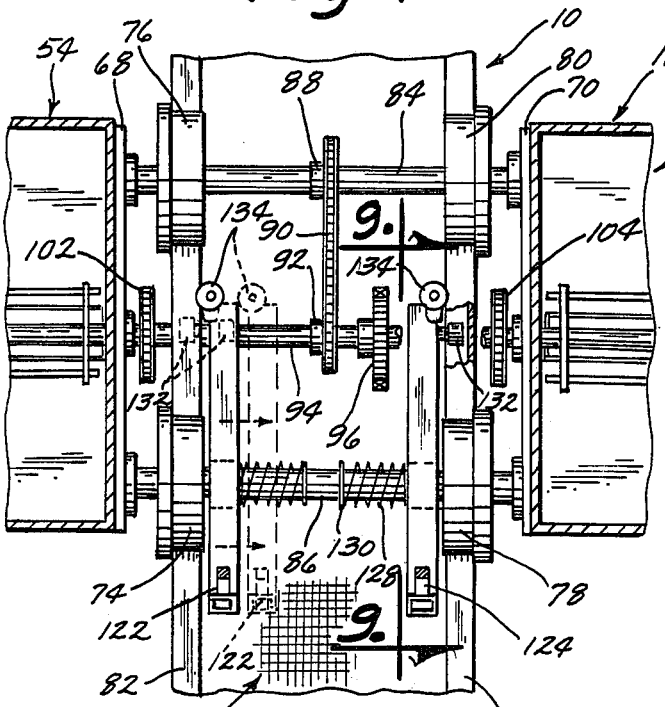
FIG. 8 is a sectional view seen on lines 8—8 of FIG. 7.

A pair of arms 68 and 70 are secured to the upper inside walls of hoppers 54 and 56 respectively and have rollers 74, 76 and 78, 80 rotatably mounted on the ends thereof as seen in FIG. 3. Each of the rollers has a reduced diameter portion which is adapted to roll upon the channels 82 which extend along the upper length of the bridge 12. Each of the rollers 74, 76, 78 and 80 also includes enlarged diameter portions which are positioned outwardly of the channels 82 to maintain the hopper assembly in the proper position. As seen in FIG. 8, the shafts 84 and 86 support the rollers 76, 80 and 74, 78 since the shafts 84 and 86 have their opposite ends journaled in the members 68 and 70. Sprocket 88 is mounted on shaft 84 and has chain 90 extending therearound. Rollers 76 and 80 are mounted on shaft 84 for rotation therewith so that rotation of the sprocket 88 causes rollers 76 and 80 to be rotated. Chain 90 extends around a sprocket 92 which is mounted on shaft 94 which has its opposite ends journaled in the side walls of the hoppers 54 and 56 respectively. Sprocket 96 is also mounted on shaft 94 and is operatively connected to the gear motor 98 by means of chain 100. Shaft 94 has sprockets 102 and 104 mounted on the opposite ends thereof which have chains 106 and 108 extending therearound. Chain 106 extends around sprocket 110 which is mounted on one end of shaft 112 which is rotatable mounted and which extends through the lower end of the hopper 54. A vaned impeller 114 is mounted on the shaft 112 to insure the proper flow of material from the lower end of the hopper. Sprocket 116 is mounted on the other end of shaft 112 and has chain 118 mounted thereon which is operatively connected to an agitator assembly 120 positioned within the hopper means to agitate the material therein to insure the even flow from the hopper.

Figure 9:
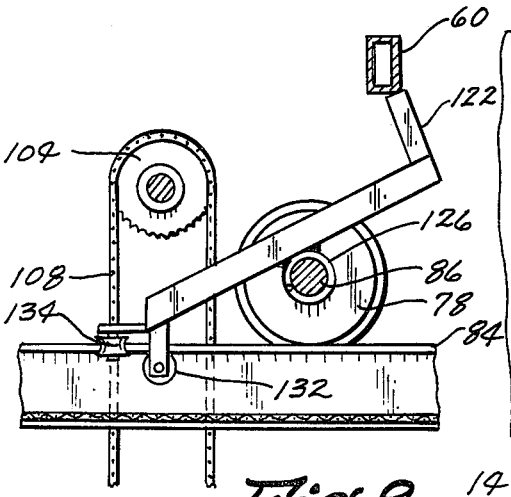
FIG. 9 is a sectional view seen on lines 9—9 of FIG. 8.

A pair of wheel mounting bars 122 and 124 are mounted on shaft 86. Inasmuch as the wheel mounting bars 122 and 124 are identical, only wheel mounting bar 122 will be described. Bar 122 has a collar or sleeve 126 mounted thereon which embraces shaft 86. The upper end of bar 122 is adapted to engage the lower end of frame 58 as best seen in FIG. 9. Bar 122 is yieldably held laterally outwardly towards channel 82 by spring 128 which embraces shaft 86 and held in position by collar 130 secured to shaft 86. Collar 126 rotatably embraces shaft 86 and is longitudinally slidably mounted thereon. A pair of rollers 132 and 134 are mounted on the lower end of bar 122 and are adapted to engage the underside and inner edge of channel 82 respectively as best seen in FIG. 9. The bar 124 is similarly mounted on shaft 86 and has a pair of rollers mounted thereon adapted to engage the underside and inner edge of the opposite channel 82. The cooperation of the arms 122 and 124 maintain the hopper assembly on the channel 82. If the hopper assembly 18 is attempted to be moved vertically with respect to the channel 82, the roller 132 on the wheel mounting bar 122 and the roller on the corresponding bar 124 engage the underside of the channel 82 as seen in FIG. 9 and prevent the vertical movement of the hopper assembly. However, the hopper assembly 18 may be easily removed from the bridge by simply moving the bars 122 and 124 inwardly so that the rollers 132 no longer engage the underside of the upper portion of the channel 82.

Figure 13:
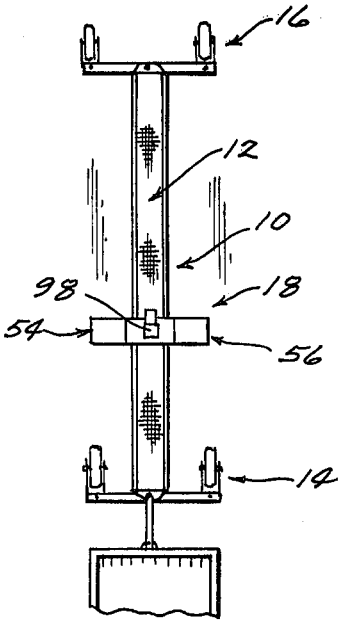
FIG. 13 is a plan view illustrating the apparatus in its travel position.

FIG. 13 illustrates the spreader 10 being pulled behind a prime mover or the like so that the spreader may be moved from one location to another. When it is desired to spread hardening material on a concrete surface 136 (FIG. 2), the frames 14 and 16 are positioned at opposite sides of the slab as indicated. The wheels on the frames 14 and 16 would be locked into position as previously described to enable the spreader and bridge to be moved transversely with respect to the slab. When the spreader and bridge have been positioned at one end of the slab, the hopper assembly 18 would be actuated so that the hopper assembly 18 is moved from one end of the bridge to the other end of the bridge. As the hopper assembly 18 moves from one end of the bridge to the other by means of the motor 98, the hardening material is spread on the concrete surface from the lower ends of the hoppers 54 and 56 through the adjustable slide gates 64. The agitator assemblies within the hoppers are actuated as the hopper assembly moves from one end of the bridge to the other so that the hardening material 62 will not bridge or clog within the hoppers. Thus, one pass of the hopper assembly 18 over the concrete surface will result in two spaced-apart bans applied to the concrete surface. As previously described, the distance between the hoppers 54 and 56 is equal to the width of one of the hoppers. After the initial pass has been made over the concrete surface, the assembly would be moved a distance equal to the width of one of the hopper assemblies. The hopper assembly would then again be moved over the concrete surface to apply two additional bans of hardening material on the concrete. Thus, two passes of the spreader assembly over the concrete surface causes four bans of hardening material to be applied to the surface. It is also recommended that the brake means 36 be moved to its braking position during the movement of the hopper assembly so that the spreader will be maintained in its proper position.

After the hopper assembly has been moved one complete cycle, the spreader and bridge assembly would then be moved to the position illustrated by broken lines in FIG. 2 to repeat the process. If the apparatus of this invention is to be used in a situation wherein an elongated rod or pipe 48 is positioned adjacent a wall or the like, the frame 14 is reversed from the position of FIG. 1 to the position of FIG. 10 so that the concave wheels 44 and 46 may roll upon the pipe 48.

Figure 12:
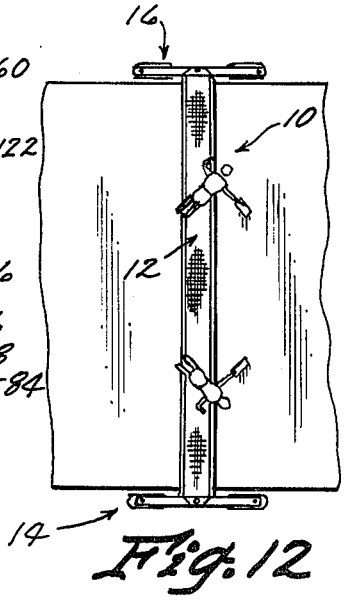
FIG. 12 is a plane view similar to that of FIG. 2 except that the hopper assembly has been removed therefrom.

The apparatus of this invention also enables workmen to perform finishing operations on the concrete such as that illustrated in FIG. 12. FIG. 12 illustrates that the hopper assembly 18 has been removed from the bridge 12. The hopper assembly 18 is quickly and easily removed from the bridge 12 by simply moving the bars 122 and 124 inwardly towards each other until the rollers 132 are positioned inwardly of the channels 82. The hopper assembly may then be removed from the bridge 12. With the hopper assembly 18 removed from the bridge, a convenient unobstructed bridge is provided for use by the workmen as illustrated in FIG. 12. It can also be appreciated that the design of the spreader assembly 18 is such that the spreader assembly 18 does not have to be removed from the bridge 12 to enable a workman to utilize the bridge 12. The substantially unobstructed upper surface of the bridge 12 is made possible due to the design of the spreader assembly 18. It can be appreciated from the drawings herein that a workman can easily step over the upper end of the spreader assembly 18. As previously described, the bridge 12 may be raised and lowered with respect to the frames 14 and 16 to compensate for various concrete thicknesses and to prevent material drift.

Thus it can be seen that a novel material spreader and bridge have been provided which accomplish at least all of its stated objectives.

I claim:

1. A material spreader for spreading material onto a surface comprising, first and second spaced-apart wheeled frames, an elongated horizontally disposed bridge means secured to and extending between said wheeled frames, said bridge means including a flat horizontally disposed worker support surface thereon, a hopper assembly movably mounted on said bridge means, said hopper assembly being removably mounted on said bridge means to permit said worker support surface to be utilized, said hopper assembly comprising a pair of hoppers positioned on opposite sides of said bridge means, each of said hoppers having upper and lower ends, the upper end of each of said hoppers adapted to receive the material to be spread, means at the lower end of each of said hoppers adapted to control the flow of material therefrom, and means for moving said hopper assembly between the ends of said bridge means, each of said hoppers having elongated discharge openings formed at the lower end thereof, the longitudinal axis of each of said discharge openings being disposed transversely to the length of said bridge means, the distance between the discharge openings in said hoppers being equal to the length of one of said discharge openings.

2. The spreader of claim 1 wherein said means at the lower end of each of said hoppers for controlling the flow of material therefrom comprises a pair of opposing, horizontally disposed gate members movable towards and away from each other.

3. The spreader of claim 1 wherein said bridge means is selectively vertically adjustably mounted on said wheeled frames to vary the distance between said discharge openings and the surface upon which the material is being spread.

4. The spreader of claim 1 wherein each of said frames comprises a horizontally disposed frame member having opposite ends, and a caster wheel mounted at each of the opposite ends of said frame member.

5. The spreader of claim 4 wherein a manually movable brake means is selectively mounted on each of said frames for preventing movement of said bridge means during the operation of said hopper means.

6. The spreader of claim 4 wherein each of said frames includes means for locking each of said caster wheels in various of its pivotal positions.

7. The spreader of claim 1 wherein at least one of said frames has a pair of alternate wheels mounted on said frame member adapted to permit one end of the bridge means to be supported on an elongated member.

8. The spreader of claim 7 wherein said alternate wheels are concave so as to be able to roll upon an elongated pipe member.

* * * * *